US008169167B2

(12) United States Patent
Bertozzi et al.

(10) Patent No.: US 8,169,167 B2
(45) Date of Patent: May 1, 2012

(54) METHODS FOR DIAGNOSING AND AUTOMATICALLY CONTROLLING THE OPERATION OF A PARTICLE ACCELERATOR

(75) Inventors: William Bertozzi, Lexington, MA (US); Robert J. Ledoux, Harvard, MA (US)

(73) Assignee: Passport Systems, Inc., Billerica, MA (US)

( * ) Notice: Subject to any disclaimer, the term of this patent is extended or adjusted under 35 U.S.C. 154(b) by 521 days.

(21) Appl. No.: 12/363,401

(22) Filed: Jan. 30, 2009

(65) Prior Publication Data

US 2009/0179599 A1 Jul. 16, 2009

Related U.S. Application Data

(63) Continuation-in-part of application No. 12/351,234, filed on Jan. 9, 2009, and a continuation-in-part of application No. 12/351,241, filed on Jan. 9, 2009.

(60) Provisional application No. 61/024,640, filed on Jan. 30, 2008, provisional application No. 61/019,944, filed on Jan. 9, 2008, provisional application No. 61/019,958, filed on Jan. 9, 2008.

(51) Int. Cl.
*H01J 23/00* (2006.01)

(52) U.S. Cl. ..... 315/507; 315/505

(58) Field of Classification Search ..... 315/500–507
See application file for complete search history.

(56) References Cited

U.S. PATENT DOCUMENTS

| | | | | |
|---|---|---|---|---|
| 2,394,070 | A | 2/1946 | Kerst | |
| 3,742,212 | A | 6/1973 | McIver, Jr. | |
| 4,381,450 | A | 4/1983 | Cappelli | |
| 4,751,978 | A | 6/1988 | Drutchas et al. | |
| 5,122,662 | A | 6/1992 | Chen et al. | |
| 5,280,252 | A | 1/1994 | Inoue et al. | |
| 5,436,537 | A | 7/1995 | Hiramoto et al. | |
| 5,698,954 | A | 12/1997 | Hirota et al. | |
| 5,783,914 | A | 7/1998 | Hiramoto et al. | |
| 6,201,851 | B1 | 3/2001 | Piestrup et al. | |
| 6,462,490 | B1 * | 10/2002 | Matsuda et al. | 315/507 |
| 6,713,976 | B1 | 3/2004 | Zumoto et al. | |

(Continued)

FOREIGN PATENT DOCUMENTS

GB 1039137 8/1966

OTHER PUBLICATIONS

International Search Report and Written Opinion for PCT/US2009/030587.

(Continued)

*Primary Examiner* — James H Cho
(74) *Attorney, Agent, or Firm* — Foley Hoag LLP

(57) ABSTRACT

Methods are described wherein the signals from various sensors that monitor parameters such as beam position, beam intensity at each turn, number of turns, extracted current, extracted beam profile in space and energy are used to determine the effect of the variation of different parameters that control the operation of an accelerator. The diagnostic measurements and adjustments may be based upon measuring and evaluating parameters as a function of turn, and are part of an automated feedback loop for achieving the proper automated operation. The methods can be used to establish proper operating values for the accelerator parameters for optimum beam operation. By the use of feedback the operation of the accelerator can be automatically controlled in real time.

22 Claims, 4 Drawing Sheets

U.S. PATENT DOCUMENTS

| | | | | |
|---|---|---|---|---|
| 6,791,097 | B2 | 9/2004 | Scheuer et al. | |
| 6,856,105 | B2 * | 2/2005 | Yao et al. | 315/505 |
| 7,122,978 | B2 * | 10/2006 | Nakanishi et al. | 315/500 |
| 7,755,305 | B2 * | 7/2010 | Umezawa et al. | 315/507 |
| 7,838,855 | B2 * | 11/2010 | Fujii et al. | 250/505.1 |
| 2001/0040220 | A1 | 11/2001 | Pedersen et al. | |
| 2002/0008450 | A1 | 1/2002 | Tanaka | |
| 2005/0231138 | A1 | 10/2005 | Nakanishi et al. | |
| 2007/0001128 | A1 | 1/2007 | Sliski et al. | |
| 2007/0115071 | A1 | 5/2007 | Barov | |
| 2007/0297565 | A1 | 12/2007 | Wofford et al. | |

OTHER PUBLICATIONS

International Search Report and Written Opinion for PCT/US2009/032651.

International Search Report and Written Opinion for PCT/US2009/030589.

International Search Report and Written Opinion for PCT/US2009/030587, Mar. 2009.

International Search Report and Written Opinion for PCT/US2009/032651, Mar. 2009.

International Search Report and Written Opinion for PCT/US2009/030589, Mar. 2009.

Lord et al., "A Diagnostic System for Optimization of the External Beam Quality of the Oak Ridge Isochronous Cyclotron", Jun. 1967, IEEE Transaction on Nuclear Science, pp. 1151-1154.

* cited by examiner

METHODS FOR DIAGNOSING AND AUTOMATICALLY CONTROLLING THE OPERATION OF A PARTICLE ACCELERATOR

CROSS-REFERENCE TO RELATED APPLICATIONS

This present application claims priority to and the benefit of U.S. Provisional Patent Application Ser. No. 61/024,640 entitled "Methods for Diagnosing and Automatically Controlling the Operation of a Particle Accelerator" which was filed on Jan. 30, 2008 by William Bertozzi and Robert J. Ledoux, and which is hereby incorporated by reference.

This present application also claims priority to and the benefit of U.S. patent application Ser. No. 12/351,234 entitled "Methods And Systems For Accelerating Particles Using Induction To Generate An Electric Field With A Localized Curl" which was filed on Jan. 9, 2009 by William Bertozzi, Stephen E. Korbly and Robert J. Ledoux, and which is hereby also incorporated by reference. U.S. patent application Ser. No. 12/351,234 claims priority to and the benefit of U.S. Provisional Patent Application Ser. No. 61/019,944 entitled "Method for Accelerating Particles Using Induction to Generate an Electric Field with a Curl Localized at a Gap" which was filed on Jan. 9, 2008 by William Bertozzi, Stephen E. Korbly and Robert J. Ledoux, and which is hereby incorporated by reference.

This present application also claims priority to and the benefit of U.S. patent application Ser. No. 12/351,241 entitled "Diagnostic Methods And Apparatus For An Accelerator Using Induction To Generate An Electric Field With A Localized Curl" which was filed on Jan. 9, 2009 by William Bertozzi and Robert J. Ledoux, and which is hereby also incorporated by reference. U.S. patent application Ser. No. 12/351,241 claims priority to and the benefit of U.S. Provisional Patent Application Ser. No. 61/019,958 entitled "Diagnostic Methods for an Accelerator Using Induction to Generate an Electric Field with a Curl Localized at a Gap" which was filed on Jan. 9, 2008 by William Bertozzi and Robert J. Ledoux, and which is hereby incorporated by reference. U.S. patent application Ser. No. 12/351,241 also claims priority to and the benefit of U.S. Provisional Patent Application Ser. No. 61/019,944 entitled "Method for Accelerating Particles Using Induction to Generate an Electric Field with a Curl Localized at a Gap" which was also filed on Jan. 9, 2008 by William Bertozzi, Stephen E. Korbly and Robert J. Ledoux, and which is hereby also incorporated by reference.

FIELD

Methods are disclosed that vary the available control actions of a particle accelerator using feedback based on sensor inputs for automating optimization of the particle accelerator performance.

BACKGROUND

Particle accelerators generally are grouped into different categories according to their fundamental concepts:

1) Those that use constant electrostatic fields such as Van de Graaff accelerators;
2) Those that make use of radiofrequency cavities in a straight line such as linear accelerators;
3) Those that use the electric fields induced by a time varying magnetic field to accelerate a particle such as the betatron; and 4) Circular accelerators that recirculate the beam of particles through a radiofrequency cavity to reach a desired energy such as a cyclotron, synchrotron, microtron, racetrack microtron or Rhodotron™.

Different names have been used to describe different combinations of the ideas represented by these categories and the concepts they represent, as they have been perceived to be advantageous in different applications. Many are discussed in books about accelerator design such as M. S. Livingston and J. P. Blewett, "*Particle Accelerators*", McGraw Hill Book Company, Inc., New York, 1962. They all apply the fundamental Maxwell equations and particle dynamics in magnetic and electric fields to accelerate particles and to form accelerated beams.

A novel configuration for a particle beam accelerator is described in pending U.S. patent application Ser. No. 12/351,234, "Methods And Systems For Accelerating Particles Using Induction To Generate An Electric Field With A Localized Curl," by William Bertozzi, Stephen E. Korbly and Robert J. Ledoux. The accelerator may have a vacuum chamber that is annular or toroidal in shape and which serves as the accelerator beamline. The beamline has an electrically conductive part and an electrically non-conductive part that serves as an acceleration gap. A magnetic field that is present in the region of the vacuum chamber controls the motion of the beam within the vacuum chamber. The accelerator has two very distinct electromagnetic field regions. One is inside the vacuum chamber/beamline where the only fields other than the magnetic guide fields are those created by the accelerating potential in the region of the non-conducting acceleration gap and those induced by the beam charge on the inner walls of the conductive portion of the vacuum chamber/beamline. The other electromagnetic field region is outside the vacuum chamber/beamline where an exciting current travels along the outside surface of the conductive portion of the vacuum chamber/beamline. These two regions are coupled only via the non-conducting acceleration gap. This accelerator will hereinafter be referred to as a "localized curl accelerator."

Most particle accelerators having a degree of complexity require methods and systems for monitoring and controlling the beams they produce. Such systems are often referred to as diagnostic systems or simply "diagnostics" and such controlling systems are often referred to as "controls".

Pending U.S. patent application Ser. No. 12/351,241, "Diagnostic Methods And Apparatus For An Accelerator Using Induction To Generate An Electric Field With A Localized Curl," by William Bertozzi and Robert J. Ledoux, describes methods and systems, including various beam-condition sensors, for use with a localized curl accelerator to provide essential data for beam evaluation and control. Certain of these methods and systems may also be applied in other types of accelerators.

In the case of the localized curl accelerator and associated diagnostics and/or sensors the specific characteristics of the accelerator introduces unique requirements for the processes of monitoring and controlling the beam that may be met by employing the exemplary diagnostics and/or sensors described therein and by employing the methods disclosed herein. Certain of these methods also are suitable for use with other accelerator types.

SUMMARY

Disclosed are methods of controlling the operation of a particle accelerator, comprising: injecting a particle beam into the accelerator; performing at least one injection phase diagnostic measurement; based upon the at least one injection phase diagnostic measurement, determining if the particle beam has been successfully injected; upon the particle beam not having been successfully injected, varying at least one injection phase control action, and repeating the process; upon the particle beam having been successfully injected, performing at least one acceleration phase diagnostic measurement; based upon the at least one acceleration phase diagnostic measurement, determining if the particle beam has been successfully accelerated; upon the particle beam not having been successfully accelerated, varying at least one acceleration phase control action, and repeating the process; upon the particle beam having been successfully accelerated, performing at least one use phase diagnostic measurement; based upon the at least one use phase diagnostic measurement, determining if the particle beam has been successfully used; upon the particle beam not having been successfully used, varying at least one use phase control action, and repeating the process; and upon the particle beam having been successfully used, further operating the accelerator.

The particle accelerator may be an electron accelerator, the particle accelerator may be a localized curl accelerator, and the particle beam may be injected by an electron gun.

Whether the particle beam has been successfully injected may be determined after one or a plurality of turns. At least one injection phase diagnostic measurement may comprise measuring a number of turns of the beam. Measuring a number of turns of the beam may comprise measuring a pulse in a signal corresponding to a passage of the beam. The pulse may be measured using a conducting electrode or a current sensor. At least one injection phase diagnostic measurement may comprise measuring beam intensity or location. At least one diagnostic measurement may comprise a conducting electrode measurement or a current sensor measurement. The current sensor measurement may comprise measurement of a power supply current. Whether the particle beam has been successfully injected or successfully accelerated may be determined at least in part by beam intensity or location.

Use of the particle beam may comprise extraction of the beam or the beam impinging upon an internal target.

An electric field may be imposed upon the beam to perturb its orbit by the application of voltage across at least a pair of internal electrodes.

DETAILED DESCRIPTION OF EMBODIMENTS

The methods disclosed herein are applicable to many acceleration systems and methods but the exemplary disclosure herein is for an accelerator that delivers energy to particles via the coupling to an electric field that possesses a vector curl at a gap and image charges flowing in conductive walls (e.g., the localized curl accelerator). Their applicability to other accelerator modalities will be recognized by those experienced in the art and such modalities are intended to be encompassed within the scope of this disclosure.

The exemplary localized curl accelerator referenced above uses the governing rules of Maxwell's equations in a novel approach that cannot be equated with methods generally used to accelerate particles which are discussed in standard texts on this subject (see for example: M. S. Livingston and J. P. Blewett, "*Particle Accelerators*", McGraw Hill Book Company, Inc., New York, 1962). The essential elements are:

1.) A magnetic core that can accommodate a time varying B field;
2.) A power supply that can provide suitable voltages.
3.) An electrically conductive vacuum chamber that encircles a portion of the magnetic core and that has a non-conducting gap; and
4.) A magnetic guide field, constant in time during the acceleration cycle, to guide the particles around the interior of the vacuum chamber in stable orbits as they gain energy.

To monitor the operation of an accelerator the diagnostic elements may be matched to the dynamical behavior of the accelerator and its electric and magnetic features as well as the nature of the particles being accelerated. The success of injection, capture and acceleration to final beam energy may require monitoring and control of the beam parameters at several stages of the acceleration process. The monitoring methods may indicate the quality of the parameters of the beam such as energy and intensity during different stages of the process. Thus, the diagnostic elements may be designed in accordance with the elements of the accelerator itself and the nature of its components and their operation.

Figure 1:
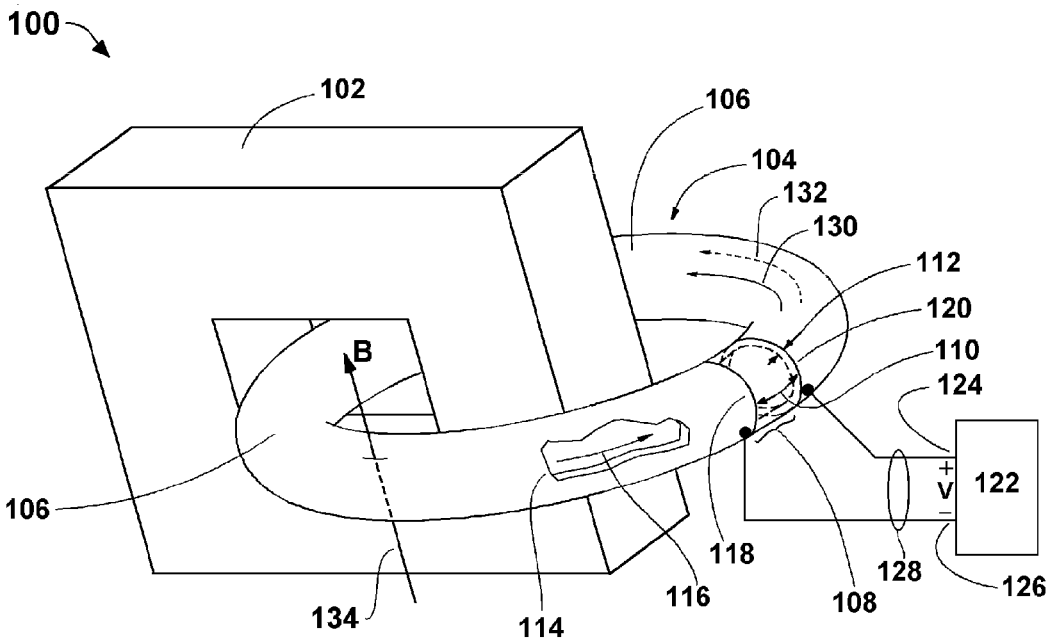
FIG. 1 shows one embodiment of a system illustrating details of an accelerator with a power supply disposed across a non-conducting gap of a vacuum chamber for use with certain of the diagnostic methods and apparatus disclosed herein.

FIG. 1 is a schematic 100 of an embodiment of an exemplary localized curl accelerator, for use with the diagnostic techniques disclosed in U.S. patent application Ser. No. 12/351,241, "Diagnostic Methods And Apparatus For An Accelerator Using Induction To Generate An Electric Field With A Localized Curl," by William Bertozzi and Robert J. Ledoux. A vacuum chamber 104 serves as a beamline and has an electrically conductive portion 106 and an electrically non-conductive portion that will be referred to as non-conducting gap 108. The vacuum chamber 104 may be generally tubular in cross-section (circular or rectangular, or other cross section) and may be toroidal in form, such as the circularly annular form illustrated or may have some other closed path connection that permits cyclic/circulating passage of a beam within. A cutaway 114 provides a view of a beam of charged particles 116 traveling within the vacuum chamber 104. The beam 116 is for example (not limitation) an electron beam and has one or more electrons moving, for example, in the direction indicated by the arrow. The cutaway 114 is for illustrative purposes only and does not represent an actual opening in the vacuum chamber 104. The non-conducting gap 108 has a gap length d 110. The conductive portion 106 of the vacuum chamber 104 has a wall thickness w 112. A magnetic guide field 134 is a B-field and guides beam particles in a beam 116 through the vacuum chamber 104 along a closed cyclic path. The magnetic guide field 134 is only indicated schematically as a single flux line, but it is recognized that the magnetic guide field may be complex, may be generated by multiple magnetic elements (not shown) and may pass through multiple or all parts of the vacuum chamber 104 to effectively guide and/or focus the beam 116. The vacuum chamber 104 surrounds a portion of an induction core 102. The conductive portion 106 of the vacuum chamber 104 has two ends 118, 120 that are separated by the non-conducting gap 108. The joints between the ends 118 and 120 of the conducting portion 106 and the non-conducting gap 108 portion are sealed by conventional vacuum sealing techniques. Electrical leads 128 connect the ends 118 and 120 to a power supply 122. Power supply 122 has a first terminal 124 that may be a positive terminal and which is connected to end 120. Power supply 122 has a second terminal 126 that may be a negative terminal and which is connected to end 118. Power supply 122 provides a voltage V that may be a time varying voltage and that may oscillate and reverse polarity periodically in a square wave fashion or with some other suitable waveform.

As an aid to understanding the operation of the accelerator in FIG. 1, temporarily consider an idealized situation wherein the conductive portion 106 of vacuum chamber 104 is considered to be a perfect conductor in a circular path around the portion of the induction core 102. Temporarily consider the power supply 122 to be an idealized voltage source characterized as having zero input or output impedance. When the power supply is connected to the ends 118 and 120 of the conductive portion 106 of the vacuum chamber 104, (and thus also across the non-conducting gap 108 of the vacuum chamber 104) a current given by $dI_O/dt=V/L$ flows in the conductive portion 106, where L, the inductance of the one-turn circuit formed by the conductive portion 106, is determined by the magnetic properties of the induction core 102 composition and geometric aspects of the inductance such as the cross-sectional area of the induction core 102. The boundary conditions imposed by Maxwell's equations demand that the current $I_O$ 130 through the conductive portion 106 be on the outer surface of the conductive portion 106 of the vacuum chamber 104. Inside the vacuum chamber 104 there is no electric or magnetic field as a result of the applied voltage V or the current $I_O$ except in the region of the non-conducting gap 108 where the electric field, $E_G$, is given by geometry to be approximately V/d where d is the gap length d 110 of the non-conducting gap 108. The role of the induction core 102 is to provide a finite inductive impedance that is coupled to the power supply 122, limiting the current $I_O$ 130 by $dI_O/dt=V/L$.

Still considering the idealized situation, a charged particle (charge q) traversing the non-conducting gap 108 in the vacuum chamber 104 will be accelerated with an energy gain of qV. This particle is guided around the induction core 102 inside the vacuum chamber 104 by an appropriate magnetic guide field 134. The particle experiences no retarding fields in the vacuum chamber 104 because all fields (except for the static magnetic guide field as discussed below) are zero except for those induced on the walls by the charge of the particle itself. As the particle travels around the induction core 102 it reenters and traverses the non-conducting gap 108 in the vacuum chamber 104 and its energy is increased by qV again. If it makes n turns (herein the terms "turn" or "turns," when referring to beam or particle motion, means a complete circuit, cycle or revolution of the vacuum chamber) of the vacuum chamber 104 it gains a total energy nqV. The path integral around the inside of the vacuum chamber 104 of E·dl in one complete path is V. Here, E is the electric field in the vacuum chamber 104 and dl represents the path length differential for the beam path (bold quantities are used to represent vectors). E is zero in the conductive portion 106 and is equal to $E_G$ in the non-conducting gap 108. It should be recognized that $E_G$ is a complex function of position in the region of the non-conducting gap and not a constant as implied by the approximate relation $E_G=V/d$. It is not described in detail herein for the purposes of simplifying the discussion. However, regardless of this complex variation, most of the field $E_G$ is located in the vicinity of the non-conducting gap and the path integral of E·dl in one complete path is rigorously V. That is, this electric field has a curl for its vector character. This distinguishes this electric field from an electrostatic field where the integral of E·dl around a closed path is zero. Conventional means (not shown) are employed for injecting and/or extracting the beam 116 into/from the vacuum chamber 104 according to techniques that will be well known to those familiar with the art.

Thus there are two very distinct electromagnetic field regions in this idealized situation. One is inside the vacuum chamber 104 where the only fields are those created by V in the region of the non-conducting gap 108, those induced by the particle charge q on the inner walls of the conductive portion 106 of the vacuum chamber 104, and those constituting the magnetic guide fields. The other field region is outside the conductive portion 106 of the vacuum chamber 104 where the current $I_O$ 130 from $dI_O/dt=V/L$ travels along the outside surface of the conductive portion 106. These two regions are coupled only via the non-conducting gap 108.

Still considering the idealized situation, an induced image charge on the inner surface of the conductive portion 106 of the vacuum chamber 104 forms current $I_I$ 132 and travels along the inner surface in the same direction as the path of the particle(s) in the beam 116. Current $I_I$ 132 is equal to the rate of flow of charge of the particle(s) in magnitude and opposite in sign. When the particle(s) is for example an electron(s) this image charge is positive. When the particle(s) in the beam 116 reaches the end 118 of the conductive portion 106 at the non-conducting gap 108 it simply crosses the non-conducting gap 108 in the vacuum and gains energy qV. However, the induced image charge (and thus the current $I_I$ 132) has no alternative but to come to the outer surface of the conductive portion 106. Upon reaching the outer surface at the end 118, the current $I_I$ 132 travels through electrical leads 128 and through the power supply 122, which has an ideally zero impedance. Thus, in this example, the current $I_I$ 132 resulting from the image charge flows through the power supply 122, electrical leads 128, and enters the inner wall of the conductive portion 106 of vacuum chamber 104 at the end 120, adjacent the non-conducting gap 108 with the voltage +V and exits at the inner wall of the conductive portion 106 at the end 118, where the voltage is zero, and returns to the power supply 122. The image charge flow provides an additional current $I_I$ 132 flow into the power supply equal to the current flow of the beam 116. The image charge flow is an image current. Thus the power supply provides power to energize the induction core 102 and additionally it provides power to the beam 116 via this coupling with the image charge or image current.

Thus far in this discussion the conductive portion 106 has been considered as ideal with no resistive impedance. In the real (non-idealized) situation, finite resistance must be considered. This situation is well treated in many texts on electromagnetic theory. Referring to the book by J. D. Jackson ("Classical Electrodynamics", Third Edition, John Wiley & Sons, 1999) the subject is treated in several places. In particular, in Chapters 5 and 8 it is shown that the main effect of the finite conductivity is to localize the currents and fields to a region of the surface called the "skin thickness". This means that fields that vanished at the surface of the idealized perfect conductor now penetrate the real conductor of this working accelerator, but die away as $e^{-x/\delta}$ where x is the distance perpendicular to the surface and δ is the skin thickness. The value of δ depends on the resistivity of the conductive portion 106 of the vacuum chamber 104 and the frequency of the external relevant electromagnetic fields considered. As an example, at 2 KHz and for copper, δ is approximately 1.5 mm. By assuring that the wall thickness w 112 of the conductive portion 106 is considerably larger than δ, the inner and outer regions of the vacuum chamber remain effectively decoupled electromagnetically. The non-conducting gap 108, however, still causes the flow of the image charge current $I_I$ 132 from the +V side of the power supply 122 into the inner surface of the conductive portion 106 of the vacuum chamber 104 and the flow of the image charge current $I_I$ 132 out of the inner surface of the conductive portion 106 into the low potential side of the power supply 122. In the real situation, the Ohmic resistance to the flow of the current $I_I$ 132 and the current $I_O$130 are no longer zero (as in the idealized situation discussed above) in the conductive portion 106, but can be evaluated using standard expressions of current flow through a medium with resistivity ρ with the current distributed in the skin thicknesses of the inner and outer surfaces as described above. Generally, for good conductors such as copper and for geometries and values of δ at the frequencies considered herein, these losses may be low compared to power consumption by other elements.

The coupling of the power supply 122 to the beam 116 in the vacuum chamber 104 through the image charge flowing into the vacuum chamber 104 via the ends 118, 120 of the conductive portion 106 at the non-conducting gap 108 cannot be represented by standard fixed electrical circuit parameters. However, an equivalent electrical circuit can be constructed to illustrate the functional behavior described herein. This is shown in FIG. 2.

Figure 2:
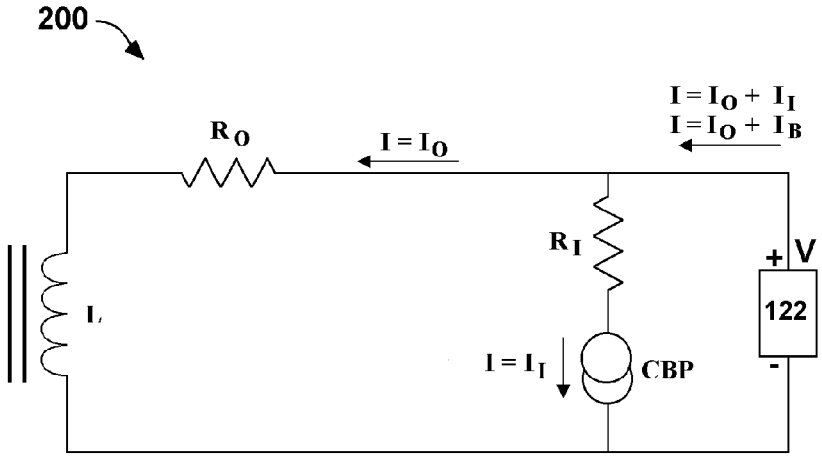
FIG. 2 shows an approximate equivalent circuit of the accelerator of FIG. 1.

FIG. 2 is an approximate equivalent circuit schematic 200 of the localized curl accelerator shown in FIG. 1. Referring to FIGS. 1 and 2, the inductance of the one-turn coil formed by the conductive portion 106 the vacuum chamber 104 around the induction core 102 is represented by the symbol L in schematic 200. The energy dissipation of the outer surface current $I_O$130 due to finite conductivity of the conductive portion 106 is represented by the current, $I_O$, flowing through the resistance $R_O$ in schematic 200. This current, $I_O$, is governed by Equation 1:

$$V-LdI_O/dt-I_OR_O=0 \quad \text{(Equation 1)}$$

The energy dissipation of the induced image current $I_I$ 132 in the inside of the conductive portion is noted by the current, $I_I$, flowing through a resistance given by the symbol $R_I$ in schematic 200. The symbol CBP denotes the beam coupling of the beam 116 to the power supply 122 via the induced image current $I_I$ 132 on the inside of the conductive portion 106. This induced image current is given by $I_I=I_B$, where $I_B$ is the circulating beam current inside the vacuum chamber 104 due to the beam 116. The image current $I_I$ 132 is supplied by the power supply 122 via the beam coupling CBP through the non-conducting gap 108. The total power supply 122 current is:

$$I=I_O+I_I=I_O+I_B \quad \text{(Equation 2)}$$

Thus the total current from the power supply 122 is the sum of the current $I_O$130 exciting a magnetic flux in the induction core 102 and the current $I_B$ due to the beam 116. The power supply 122 supplies energy to the magnetic field in the induction core 102 and to the beam 116. If the beam 116 is not present, only the magnetic energy is supplied. The power supplied by the power supply 122 is given by $P=V(I_O+I_B)$. In any practical situation, the losses due to the dissipation in $R_O$ and $R_I$ are small compared to the dissipation in the magnetic induction core 102 due to hysteresis and internal currents and therefore the Ohmic losses may be neglected. The dissipation in $R_I$ causes a decrease in the energy gain of the circulating beam 116. In general this decrease is much smaller than the qV beam energy gain for each turn and may again be neglected in terms of beam dynamics except in evaluating the final particle energy.

Referring again to FIG. 1, one exemplary configuration of the localized curl accelerator described above is shown. The induction core 102 forms a complete magnetic circuit. The vacuum chamber 104 provides an evacuated region for the beam 116 to circulate about the induction core 102. The beam 116 is guided by magnetic guide field 134 that constrains all beam orbits to lie within the confines of the vacuum chamber 104. The vacuum chamber (though not necessarily of circular shape) 104 encircles the induction core 102. The current $I_O$ 130 flows on the outer surface of the conductive portion 106 of vacuum chamber 104. The non-conducting gap 108 has a power supply 122 connected across it. The currents $I_O$ 130 and $I_B$=current $I_I$ 132 flow out of the first terminal 124 of power supply 122 (positive terminal) and into the second terminal 126 of the power supply 122 (negative terminal). In FIG. 1, the power supply 122 presents a voltage V across its terminals 124, 126 as discussed above and the characterization of the first terminal 124 as + and the second terminal 126 as − only implies that the + is at a higher potential than the − terminal when V is positive.

For an accelerator similar to that of system 100 (FIG. 1), it is a challenge to monitor the processes of injection, capture, acceleration to the final beam energy and extraction because of the electromagnetic separation of the interior and exterior regions of the vacuum chamber. One way of monitoring the beam is to use intercepting beam stops located at different positions of the beam orbits. This technique may require employing vacuum-tight movable couplings for operating movable probes inside the vacuum chamber from outside. In order to avoid interception of the beam, non-intercepting transducing elements may be employed to observe and forward signals from the relevant phases of the beam production process. These elements may obtain magnetically and electrically induced signals and may involve fixed and movable vacuum-tight couplings.

The processes of injection and capture are critical to the success of the accelerator. An electron gun, for example, may be present at an inner radius and may produce a beam of particles (1) that are synchronized with the application of the voltage V to the non-conducting gap of the accelerating cavity and (2) that lasts for a duration determined by the application at hand. In one embodiment, this may be a short burst of particles, such that the burst has ended before the leading edge completes one circuit of the vacuum chamber. In another embodiment this may be a long burst of particles lasting as long as the sweep of the induction core from $-B_C$ to $+B_C$, where $B_C$ is the maximum field in the induction core; in some cases it may be desirable that $B_C$ may approach or reach core saturation.

The critical period for injection and capture may encompass a few to a dozen circuits or turns of the vacuum chamber by the injected beam, such that if those circuits have been successfully negotiated the beam is considered captured; if this number of circuits were not achieved it would be important to understand where and when the injected beam had been lost.

When captured, the beam progresses to be accelerated to full energy. However, due to imperfections in the patterns of the guiding magnetic fields and other design parameters, a portion of the beam or the entire beam may be lost on its way to gaining the final energy. Knowing when and where this loss occurs is essential to diagnosing the problem and developing adjustments to mitigate or correct the situation.

Extraction of the beam at full energy may also require special magnetic and/or electric signals to be applied to the beam to kick it out of a stable orbit to be captured by an extraction system. Similarly, if the beam is used with an internal target rather than being extracted, it may be important to know when to initiate that process. Thus, having a signal or signals that establish that the beam has reached full energy is also important.

During routine operation of the accelerator beam characteristics may be affected by many variables, such as but not limited to temperature and voltage fluctuations, environmental changes and unexpected events.

Having methods for monitoring and diagnosing the characteristics of the beam at all phases of operation is important. Methods are disclosed in U.S. patent application Ser. No. 12/351,241, "Diagnostic Methods And Apparatus For An Accelerator Using Induction To Generate An Electric Field With A Localized Curl," by William Bertozzi and Robert J. Ledoux whereby signals from non-intercepting transducing elements allow various attributes of the beam in the accelerator to be determined, such as:

1.) the number of turns a portion of the beam has traversed in the vacuum chamber;
2.) the energy of the beam at each location of interest;
3.) the intensity of the beam at each circuit or turn and location;
4.) the motion of the beam about its equilibrium orbit;
5.) the locations and times at which beam losses occur;
6.) the effects of space charge on beam intensity and orbital motion;
7.) the effects on beam intensity and orbital motion due to ions produced by beam collisions with residual gas in the vacuum chamber;
8.) the quality of operation of the accelerator and the effects of mitigation strategies for perturbations; and
9.) the effective duty cycle of the extracted or internally utilized beam.

These and other embodiments described therein are exemplary of possible applications of the technology disclosed therein for the monitoring of charged particles during acceleration. Although the embodiments are taught in application to a few specific exemplary localized curl accelerator types, it is recognized that they have broader applicability. Those experienced in the art will recognize that there are extensions, modifications and other arrangements of the important elements disclosed that can be implemented and they are intended to be encompassed in the scope of this disclosure.

In one embodiment the transducing element consists of conducting electrodes that do not intercept the beam, placed at different locations in the chamber out of the path of the particle beam. Such an exemplary embodiment is shown in FIGS. 3A and 3B.

Figure 3A:
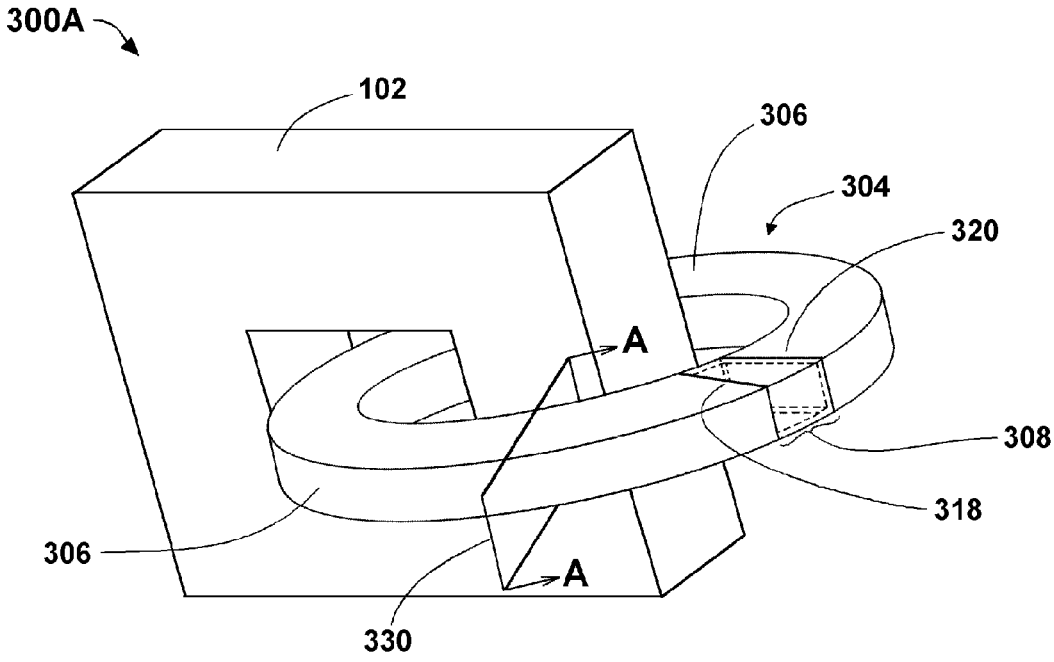
FIG. 3A shows one embodiment of a system similar to the system of FIG. 1 and having a vacuum chamber with a rectangular cross-section.

FIG. 3A is a schematic 300A illustrating a system of an exemplary localized curl accelerator similar in construction and operation to that shown in FIG. 1, except that the vacuum chamber 304 is (for example, not for limitation) rectangular in cross-section. The vacuum chamber 304 serves as a beamline and has an electrically conductive portion 306 and an electrically non-conductive portion referred to as non-conducting gap 308. The conductive portion 306 of the vacuum chamber 304 has two ends 318, 320 that are separated by the non-conducting gap 308, which is used as an acceleration gap. The joints between the ends 318 and 320 of the conducting portion 306 and the non-conducting gap 308 portion are sealed by conventional vacuum sealing techniques. An imaginary cutting plane 330 defines the location of a cross-sectional view in the direction A-A is indicated cutting the electrically conductive portion 306 of the vacuum chamber 304. The accelerator has an inductive core 102.

Figure 3B:
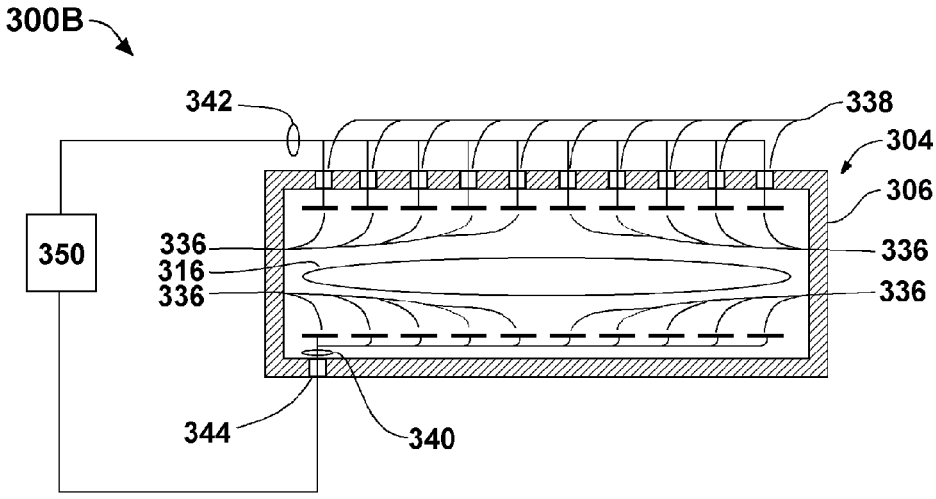
FIG. 3B shows a cross-sectional view of a portion of the system of FIG. 3A, illustrating an embodiment of diagnostic apparatus.

FIG. 3B is a cross-sectional view 300B of a portion of the system of FIG. 3A, showing the conductive portion 306 of the vacuum chamber 304, taken at the cutting plane 330 (FIG. 3A) looking in the direction A-A (of FIG. 3A) and showing additional detail not shown in FIG. 3A.

Referring to FIG. 3B, the conductive portion 306 of the vacuum chamber 304 encloses a beam 316 traveling into the plane of the paper and indicated in this view by its cross-sectional profile (elliptical, for example). One or more conducting electrodes 336 are mounted within the conductive portion 306 of the vacuum chamber 304. The conductive electrodes 336 are isolated electrically from the walls of the conductive portion 306 of the vacuum chamber 304 by conventional means (not shown) and are provided with external connections through the walls of the chamber. The conductive electrodes 336 may be multiple and may be arranged in a regular array (as shown) or another pattern as may be desired and may be arranged on one or more sides of the beam 316. Each of the conductive electrodes 336 has an electrical lead for connection. Each lead may pass through the conductive portion 306 of the vacuum chamber 304 through a single-lead hermetic feedthrough 338 as indicated for leads at the top of the conductive portion 306. In that case leads 342 may connect to instrumentation 350 for monitoring and analyzing signals from the conductive electrodes 336 conveyed by the electrical leads 342. Alternatively, the leads may be bundled into a cable 340 and pass through the conductive portion 306 of the vacuum chamber 304 through a multi-lead hermetic feedthrough 344 as indicated for the leads at the bottom of the conductive portion 306. In that case the leads in cable 340 may also connect to instrumentation 350 for monitoring and analyzing signals from the conductive electrodes 336. (Of course, either single-lead feedthroughs, one or more multi-lead feedthroughs, or a combination thereof may be used.) The instrumentation is designed so that the conductive electrodes 336 may each present high (relative to other conductive paths of the system) resistive impedances to current flow. Each conductive electrode 336 will receive an induced voltage, $V_I$, created by the image charge, q, from the beam passing nearby. This $V_I$ will be induced according to the standard rules of electromagnetism and will depend on q, distributed capacity and the impedance of the circuit. This $V_I$ presents a signal that a certain amount of beam charge has reached a specific location in the vacuum chamber 304 at a specific time. Instrumentation 350 may consist of purpose-built instruments and/or may comprise a general purpose microprocessing system.

This diagnostic scheme provides the following information on accelerator performance:

1.) A beam charge pulse that lasts less that the time for one turn will show up (depending upon the electrode placement and spacing) as a signal on one or a few of the conductive electrodes 336 that couple via the induced charge. These signals convey information to determine the position of the beam 316 as it orbits around the vacuum chamber 304, and as the pulses are counted they may establish the number of turns (circuits of the vacuum chamber 304) having been executed and the losses from each turn. The amplitude oscillations of the beam about the equilibrium orbit may be determined as well, and the changes in orbit position as the beam is accelerated on each pass through the accelerating region at the non-conducting gap 308 of the vacuum chamber 304. By counting the number of pulses in the signals induced on the pads the number of circuits or turns is determined, and thus the energy of the beam may be known at any time because the energy gain is qV for each turn (where the charge of the particles is q). Similarly, it can be established when the beam 316 has reached the full energy. The correlation of energy and conductive electrode 336 position can also be used as a diagnostic method. If the beam is lost in some region of the vacuum chamber 304, this position may be determined as may be the onset of beam loss by the changing amplitude of the signals for successive turns.

2.) The beam pulse may be longer than in the above case, as by injection continuing until the full energy is reached for the first particles injected. In this case, the progression of the beam 316 through the acceleration process still can be monitored by the timing and amplitude of the signals induced on the conductive electrodes 336. This allows monitoring the entire acceleration process with an accelerating chamber full of charge. The beam 316 will have components at all energies from that of injection up to that of extraction or use with an internal target and different conductive electrodes 336 will have signals induced from beam components at different energies. This allows the additional monitoring of the effects of the interaction of different components of the beam via space charge effects and the generation of ions in the residual gas in the vacuum chamber 304.

3.) The beam pulse may be longer than the time required for acceleration to full energy in order to achieve higher beam duty cycle. In this case, the signals on the conductive electrodes 336 will allow a determination of the quality of operation during the full duty cycle and will provide an opportunity to control and adjust beam quality.

Figure 4A:
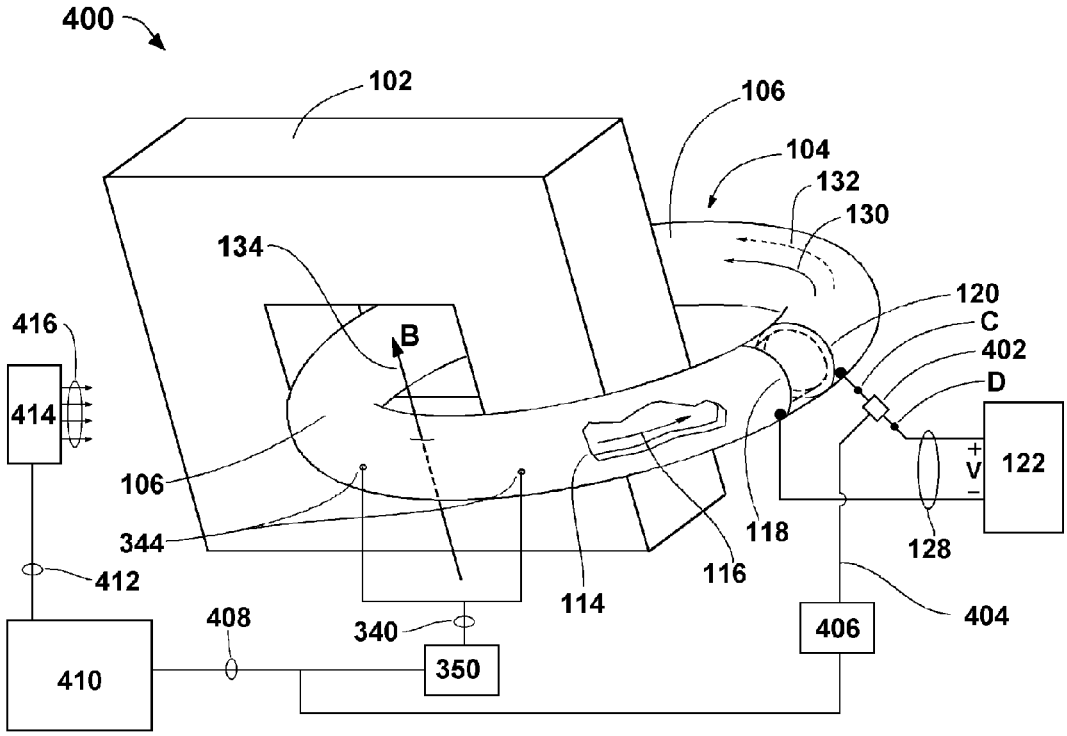
FIG. 4A shows another embodiment of an accelerator with diagnostic apparatus, including a current sensor for detecting the current in the power supply leads.

FIG. 4A is a diagram of a system 400 comprising an exemplary localized curl accelerator similar to that in FIG. 1 with the embodiment of a current sensor for detecting the current flowing to the power supply 122 for the accelerator and with sensors for various other beam characteristics. It also includes control means for controlling the accelerator. The accelerator of system 400 is similar to the accelerators of FIG. 1 and FIG. 3A. Items with like reference numbers to those in FIGS. 1, 3A, and 3B are like items with like functions. Referring to FIG. 4A, the vacuum chamber 104 may be generally tubular (of circular cross-section as shown in FIGS. 1 and 4A or of rectangular cross-section as shown in FIGS. 3A and 3B, or having another other cross-sectional shape) and may be circularly annular as illustrated or may have some other closed path connection that permits cyclic/circulating passage of a beam within in a circular path around a portion of the induction core 102. A cutaway 114 provides a view of a beam of charged particles 116 traveling within the vacuum chamber 104. (The cutaway 114 is for illustrative purposes only and does not represent an actual opening in the vacuum chamber 104.) Again referring to FIG. 4A, a transducing element may measure the current flowing to the power supply 122 from the conducting portion 106 of the vacuum chamber 104. By introducing a current sensor 402 in either of the electrical leads 128 connecting the power supply 122 to the ends 118, 120 of the conductive portion 106 of the vacuum chamber, the total current $I=I_O+I_B$ can be measured (see the circuit shown in FIG. 2). The currents $I_O$ 130 and $I_B$=current $I_I$ 132 flow out of the first terminal of power supply 122 (positive terminal) and into the second terminal of the power supply 122 (negative terminal). The current sensor 402 may be connected, for example, at connection points C and D. This current sensor may be a low impedance resistor in the power supply 122 electrical leads 128; the voltage across this resistor would indicate the current passing through the electrical leads 128. (An internal resistance of the power supply 122 with suitable connections, may serve the same purpose). A signal representing the current I may be generated by the current sensor 402 and transmitted by electrical lead(s) 404 to instrumentation 406, which may consist of purpose-built instruments and/or may comprise a general purpose microprocessing or other computing system for analysis of the current I and for extracting and processing additional information and for decision making.

One or more conductive electrodes (not shown, but similar to electrodes 336 in FIG. 3B) may be included within the conductive portion 106 of the vacuum chamber 104 at one or more distinct locations for sensing characteristics of the beam 116 and may consist of one or more arrays of conductive electrodes (not shown, but similar to electrodes 336 in FIG. 3B) for example. Conductive electrodes within the conductive portion 106 of the vacuum chamber 104 may connect through one or more hermetic feedthroughs 344 (two shown for example, not for limitation) at one or more locations (shown for example, not for limitation) and through cable 340 to instrumentation 350. Instrumentation 350 and instrumentation 406 may connect through cables 408 to controller 410. (It will be understood that this and other communications described herein as being carried out by cable may alternatively be carried out by wireless means. It will be further understood that required instrumentation, shown here as instrumentation 350 and 406 in two locations, may be deployed in one or more locations as may be convenient.) Controller 410 may consist of purpose-built control elements and/or may comprise a general-purpose microprocessing or other computing systems(s) making accelerator control decisions and executing accelerator control algorithms for accelerator control. Controller 410 may convey control commands to control elements 414 via a cable 412 (electrical, optical, etc.) and may include display and other communications means. Control elements 414 may comprise power supplies (including without limitation power supply 122), magnet control system (including without limitation control of magnets for producing guide field 134), actuators, and other accelerator control elements as are conventionally employed (but not shown in FIG. 4A) in accelerator control and as will be well known to those skilled in the art. Some examples of other such accelerator control elements may include, without limitation, elements for beam injection and extraction (or use with an internal target), cooling and temperature control elements, guide field magnets, vacuum system controls, acceleration controls, controls to remove ions generated by the beam, etc. Control elements 414 may have direct linkages 416 to elements of the accelerator system 400 that may include, without limitation, electrical linkages, magnetic linkages, optical linkages, mechanical linkages, etc. Controller 410 may control the system 400 to effect changes in the motion of the charged particles in the beam 116.

Figure 4B:
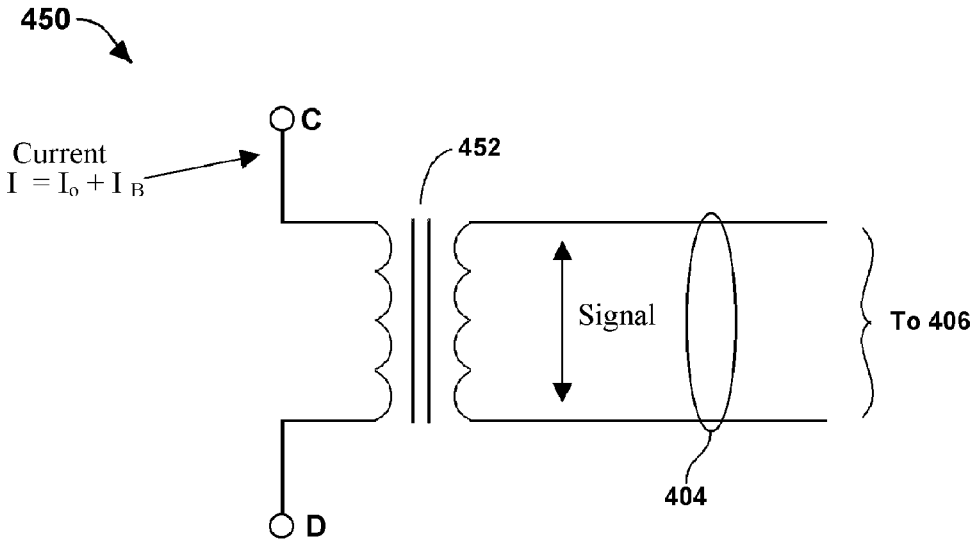
FIG. 4B is a schematic of a circuit of a current sensor.

FIG. 4B is a schematic 450 of a circuit of an alternative current sensor 402 embodiment that may be employed in system 400 or a similar system. Referring now to FIGS. 4A and 4B, in this embodiment the current sensor 402 is a transformer 452, for example a toroidal transformer, that senses the magnetic field caused by the current flow I from the power supply 122. The voltage from the transformer 452 depends on the time rate of change of the current I in the electrical leads 128 to the power supply 122. Other methods for sensing the current will be known to those experienced in the art and they are intended to be encompassed in this disclosure.

The signal available from one of these current sensors (a conventional resistive current sensor or the transformer 452) may provide the following diagnostic information:

1.) A beam charge pulse that lasts less that the time for one turn will show up as a current pulse in the power supply lines for each revolution ("turn") of the beam. By counting these pulses the number of turns successfully executed can be determined. The beam energy will be given by the number of turns executed and the voltage V. By measuring the integrated charge of each pulse the beam loss for each turn can be determined. The success of the injection process, the capture process, the acceleration process and the extraction or internal utilization process can be monitored for a short beam charge pulse. If there is a loss of beam, the number of turns the beam has executed (and consequently the beam energy) as well as the position of the beam where the loss is taking place can be determined.

2.) The beam may be injected continuously over the time necessary for the maximum energy to be achieved by the first particles injected. In this case the current from the beam grows as the number of revolutions of the beam increases. The current in the power supply lines due to the beam grows accordingly with time. By monitoring the current as a function of time, the condition of the beam at each turn, at each radial position and energy can be monitored.

3.) The beam may be injected continuously over a time greater than that required for the maximum energy to be achieved. In this case the current from the beam grows as the number of revolutions of the beam increases. The current stops growing as the fully accelerated beam is extracted (or as, for example, an internal beam target is used). The current in the power supply lines due to the beam grows accordingly with time and reaches a stable value. By monitoring this current as a function of time, the condition of the beam at each turn and energy is monitored. The effective duty cycle of the beam is determined.

4.) For all beam durations the signals from the current in the lines to the power supply will allow a determination of the condition of the beam as a function of position, time and energy and the correlations will allow a determination of the same effects discussed above for the signals from the conductive electrodes 336 (FIG. 3B).

In summary, the diagnostic measurements discussed above may detect the particle beam and/or the power supply current I and may provide knowledge of:

D1. The power supply current I and the beam current $I_B$;

D2. The completion of one turn of the beam, and its intensity;

D3. The radial location of the beam after one turn;

D4. The vertical location of the beam during any turn;

D5. The radial location and intensity of the beam during any turn;

D6. The attenuation of beam intensity as a function of the number of turns, and the location where the beam intensity is lost;

D7. The turn number and location of beam extinction;

D8. The energy of the beam as correlated to the number of turns;

D9. The influence of the amount of charge stored in the vacuum chamber on the beam intensity at any specified number of turns;

D10. The influence of the vacuum on the beam intensity at any specified number of turns; and D11. The extracted or internally utilized beam intensity.

Of course, other variables may be measured as well, as will be known to a person of skill in the art. It is important to recognize that these diagnostic measurements permit many of the characteristics of the beam to be known as of a particular turn during the acceleration process, and hence will allow those characteristics to be compared to desired or nominal characteristics for the given turn.

The methods of detection discussed earlier provide signals about the number of beam turns accelerated, and the condition of the accelerated beam at differing locations in the accelerator, at differing times during acceleration and for different beam intensities. Among others, the control actions that are available to improve and automatically control the accelerator operation consist of adjustments to:

V1. The beam injection energy;

V2. The beam intensity at injection;

V3. The direction of the beam at injection (vertically and horizontally);

V4. The position of the beam at injection (radially, vertically and horizontally);

V5. Electric and magnetic field elements to perturb the orbits of the particles at injection;

V6. The current distribution in the magnetic elements that form the guide field and determine the pattern of magnetic guide fields in the guide region;

V7. The temperature of the induction core;

V8. The temperature of the magnets providing the guide field;

V9. The vacuum in the accelerating vacuum chamber;

V10. Electric and magnetic field elements to perturb the orbits of the particles during acceleration and extraction or use with an internal target;

V11. The voltage of the power supply that connects to the vacuum chamber and is responsible for providing the beam acceleration; and V12. The voltages on elements in the vacuum chamber used to remove ions generated by the beam.

Of course, other parameters may be adjusted as well, as will be known to a person of skill in the art. It should be recognized that constant or varying electric fields may be imposed upon the beam to perturb its orbit by the application of voltages to internal electrodes such as but not limited to those which are shown in FIG. 3B for use in sensing the beam and its characteristics.

These control actions may be taken to ensure proper operation of the accelerator and to optimize the number of successful turns of the beam and the beam current at extraction or other use. They may be used singly or in combination. The system parameters may be adjusted as part of a feedback loop to optimize extracted or internally utilized beam current and emittance or they may be set partially or even completely manually in distinct steps of operation.

As an example of a control feedback loop, consider the following possible initial startup actions sequence for the accelerator. For example, not limitation, the accelerator is assumed to be an electron accelerator of a design such as that discussed above and the beam injection means is assumed to be an electron gun.

S1. The vacuum quality in the vacuum chamber is compared to the nominal allowed operational values.

S2. The power supply voltage is checked by comparing it to predetermined desired values.

S3. The field established in the induction core when the power supply is pulsed is determined (either by measurement or by calculation based on a L and I) and compared to predetermined desired values at three or more times: start of cycle; middle of cycle; and end of cycle.

S4. The electron gun is checked for proper heating of the filament and emitter.

S5. The guide field magnets are powered to predetermined currents in the magnet coils or they are powered to establish predetermined guide field patterns in the vacuum chamber.

S6. The injection voltage is turned on to a predetermined value.

S7. The emitted current from the electron gun is measured and compared to predetermined values.

Of course, other steps may be included in the startup sequence as well, as will be known to a person of skill in the art.

Once proper operation of the individual elements is assured by the system controls with comparisons to preset values for the components, the accelerator is ready to be operated to produce an accelerated beam. The preset values may have been determined by computation of beam orbits and/or by previous measurements and successful accelerator operation. If any preset value is not possible then the controller may present an alarm with a summary of the results.

Figure 5:
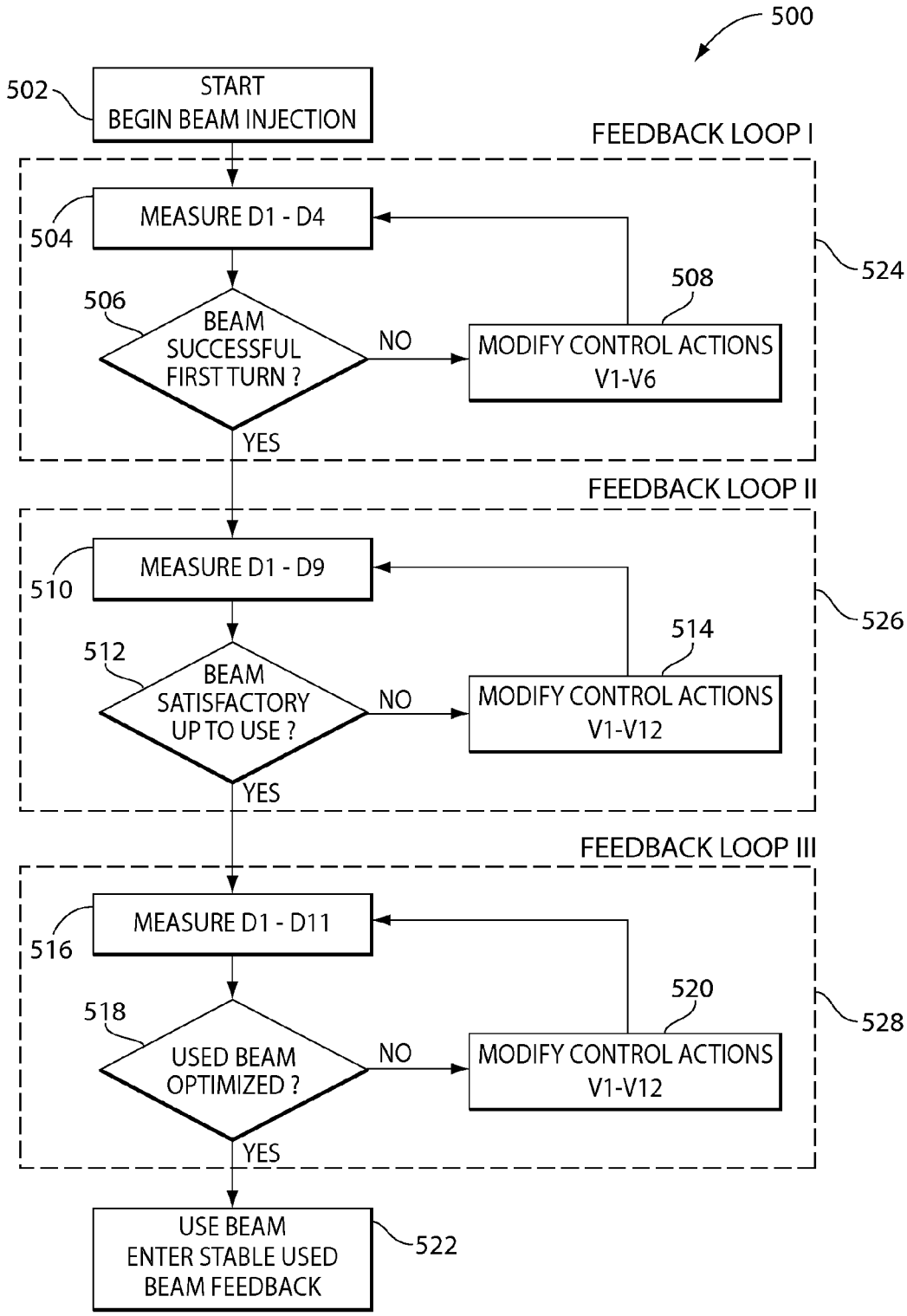
FIG. 5 is a flow chart illustrating an embodiment of the accelerator control methods disclosed herein.

A flow chart 500 for an embodiment of an automated start-up and operational procedure for the exemplary localized curl accelerator is shown in FIG. 5. (It will be understood that this embodiment may also be utilized with other accelerator designs as appropriate, if necessary with modifications to conform to specific accelerator characteristics as will be understood by a person of skill in the art.) An embodiment of an automated start-up and operational procedure of the accelerator using the diagnostic measurements D(j) and control actions V(i) is illustrated in the flow chart 500. Of course, other diagnostic measurements and control actions may be accommodated as well. The sequence may be programmed to optimize a beam intensity (that is, the beam current $I_B$) at some specific location in the vacuum chamber or after a specific number of turns of the beam (although other variables may be optimized) and to follow the beam to extraction or use with an internal target with a final optimization of the beam intensity. This procedure may be used to establish the predetermined parameters used to establish the initial tune up described above. (Hereinafter, beam extraction and use of the beam with an internal target may collectively be referred to as "beam use.")

The effect of variations of a control action V(i) on a diagnostic measurement D(j) may be compared in decision steps 506, 512, and 518 to predetermined or calculated values that may be stored in a lookup table of results for beam intensity or beam current, number of turns, energy, extracted or internally utilized beam and other characteristics that establish proper and intended operation. This procedure may use predetermined algorithms that make the comparisons in the lookup table and correlate the different D(j) and the sequence order for the adjustments. These algorithms may be established by computation and modeling and by experiment from actual accelerator operation, thus accounting for particular operational behaviors. The term "optimize" may refer to maximizing the beam intensity at a location relevant for the diagnostic D(j) by increasing or decreasing a parameter V(i). (It may be convenient however to optimize another beam characteristic.) A false local beam intensity maximum (or maximum in another characteristic) may be achieved and this may be investigated by random variations of the sequences for the V(i) and the correlations in different D(j). This feature may be part of the predetermined algorithms.

The procedure disclosed in flow chart 500 may include sequentially, the startup process 502 and three distinct subprocesses indicated as feedback loop I 524, feedback loop II 526, and feedback loop III 528. The startup process 502 includes for example such normal initiation steps as S1-S7. The process of feedback loop I 524 controls the initiation of operation from preparation for first beam injection through successful completion of a first complete turn of the beam with optimized beam intensity and position at completion of the first turn of the beam. (Optionally, this feedback loop may be extended to encompass an additional number of turns, sufficient to ensure that the beam clears the injection gun or passes another similar milestone.) The process of feedback loop II 526 controls operation from completion of the first successful complete turn of the beam (or from completion of some predetermined greater number of turns) through obtaining satisfactory beam properties up through first satisfactory beam extraction from the accelerator or first satisfactory use of the beam with an internal target (collectively, "first satisfactory beam use"). The process of feedback loop III 528 controls operation from first satisfactory beam use through optimization of the extracted beam. Following optimization of the used beam, there follows a step 522 of continued operation and use of a stable extracted or internally used beam using control parameters established by the previous processes. It is to be understood that in each feedback loop the value of one or more measured diagnostic quantities may be compared to desired or nominal values for a nominal beam having completed the same number of turns or being at the same stage of acceleration as the actual beam.

The first feedback process disclosed in FIG. 5 is shown by the first feedback loop (Feedback Loop I 524) of the flow chart. At step 504, some or all of diagnostic measurements D1-D4 may be made. (Hereinafter, measurements D1-D4 shall be referred to as "injection phase diagnostic measurements.") At decision step 506, it may be determined if the beam has successfully executed a first turn of the accelerator (or optionally if it has successfully executed an additional number of turns, as discussed above). Successful completion may be based on the beam completing the required number of turns, or may also be based upon the beam having measured characteristics that meet predetermined nominal values or thresholds. If the answer is "No", then at step 508 this response may activate a retuning of the system according to variation of some or all of control actions V1-V6 about the values predetermined from calculation and/or prior experience for a successfully tuned accelerator. (Hereinafter, control actions V1-V6 shall be referred to as "injection phase control actions.") Some or all of the values V1-V6 may be varied about their preset values in sequence until each produces the best (or a satisfactory) beam intensity for the first turn (or first few turns) of the accelerator and the proper location in space for that first orbit. The sequence of variation may be altered in a random fashion to establish the best operation and to avoid the possibility of a local maximum that is not the best possible. The variations may be carried out automatically according to a predetermined algorithm, or may be performed partially or even completely manually. It will be understood that other parameters than V1-V6 may be varied in this stage of operation as well. If the process cannot terminate successfully, the system may produce an alarm (not shown) and/or a history log(not shown) of the changes V(i) and results D(j).

It should be noted that one purpose of having a specialized Feedback Loop I 524 for the first turn or few turns is to ensure that the injected beam misses the injection apparatus, which may be an injection gun. As discussed previously, the beam gains energy at each turn. As the energy increases with each turn the orbits expand in average radial location. Until this expansion is sufficient to have all successive orbits avoid the injector, the system may rely on betatron oscillations of the beam (in vertical and radial position) to ensure the beam missing the injection apparatus. This may require an adjustment of injection apparatus position, injection direction, injection energy, beam intensity and guide field values as is carried out in V1-V6.

Once the criteria for the successful completion of Feedback Loop I are met (that is, once the inquiry at decision step 506 returns a "Yes" answer), the process may proceed to Feedback Loop II 526. At step 510, some or all of diagnostic measurements D1-D9 are made. (Hereinafter, measurements D1-D9 shall be referred to as "acceleration phase diagnostic measurements.") At decision step 512, it is determined if the beam properties are satisfactory up through beam use. If the answer is "No", at step 514 this response activates a retuning of the system according to variation of some or all of control actions V1-V12, similar to that described with respect to actions V1-V6 at step 508. (Hereinafter, control actions V1-V12 may be referred to as "acceleration phase control actions.") Feedback Loop II 526 processes the beam from the end of Loop I through the full energy first beam use. Some possible adjustments such as core and magnet temperature (V7 and V8) monitor possible system changes and adjust coolant flow appropriately. Other adjustments deal with beam position and energy at different positions and vary the guide fields at different locations to avoid losing the beam. One possibility that could cause the beam to be lost is an unstable tune of the guide magnetic fields as a function of position. Resonances may be encountered that deflect the beam into the walls of the vacuum chamber at some radius. These resonances may also cause the beam profile to expand sufficiently so as to cause a loss of intensity at extraction or use with an internal target or at some intermediate energy less than that of use without losing the entire beam. (A way to study and quantify these resonances is by perturbing the orbits by electric fields applied via voltages on the electrodes discussed earlier.) Another cause for concern in regard to beam loss is the generation of ions in the residual gas by collisions of the beam with the residual gas atoms. The diagnostic measurements D(j) may detect beam losses and beam position and the adjustments V1-V12 treat each of these possibilities and mitigate beam losses. The beam is brought to final energy ready for use. The variations V1-V12 may be carried out automatically according to a predetermined algorithm, or may be performed partially or even completely manually. It will be understood that other parameters than V1-V12 may be varied in this stage of operation as well. If Feedback Loop II 526 is not successful according to predetermined conditions an alarm may be established with a history of all adjustments and diagnostic readings.

During feedback loop I 524 and feedback loop II 526 the beam may be a short pulse only encompassing a spatial extent less than one turn or it may encompass a few turns. Following successful management of this short duration beam through feedback loop II 526 the beam may be expanded in duty cycle so that the full range of energies is encompassed in the vacuum chamber and every turn is occupied with beam. This will change the effects of space charge interactions and ion production. The management of the beam to the full energy for extraction or internal use may include this part of the automated adjustments.

Once the criteria for the successful completion of Feedback Loop II 526 are met (that is, once the inquiry at decision step 512 returns a "Yes" answer), the process may proceed to Feedback Loop III 528. Feedback Loop III 528 begins at the full energy beam condition and optimizes the extraction of the beam or use of the beam with an internal target. At step 516, some or all of diagnostic measurements D1-D11 are made. (Hereinafter, measurements D1-D11 shall be referred to as "use phase diagnostic measurements.") At decision step 518, it is determined if the extracted or internally used beam properties are optimized to predetermined requirements. If the answer is "No", at step 520 this response activates a retuning of the system according to variation of some or all of control actions V1-V12, similar to what was described with respect to actions V1-V6 at step 508. (Hereinafter, control actions V1-V12 may be referred to as "use phase control actions.") Feedback Loop III 528 processes the beam from the full energy first beam extraction or internal use through the optimization of the extracted or internally used beam. This feedback loop includes obtaining the appropriate beam intensity and beam profile in space and energy. This tune may be accomplished using a short beam and finally may use the high duty cycle operation wherein the beam fills the entire vacuum chamber occupying all turns and all energies from injection to use. The variations V1-V12 may be carried out automatically according to a predetermined algorithm, or may be performed partially or even completely manually. It will be understood that other parameters than V1-V12 may be varied in this stage of operation as well. As with the earlier feedback loops a failure to meet preset standards may produce an alarm with a history of all diagnostic readings and adjustments.

Once the criteria for the successful completion of Feedback Loop III 528 are met (that is, once the inquiry at decision step 518 returns a "Yes" answer), the process may proceed to step 522, the continued operation and use of a stable beam using control parameters established by the previous processes.

The embodiments described herein are exemplary of the possible applications of the technology disclosed herein for the acceleration of charged particles. Those experienced in the art will recognize that there are extensions, modifications and other arrangements of the important elements disclosed that can be implemented and they are included as part of this disclosure.

The invention claimed is:

1. A method of controlling the operation of a particle accelerator, comprising:

a) injecting a particle beam into the accelerator;

b) performing at least one injection phase diagnostic measurement;

c) based upon the at least one injection phase diagnostic measurement, determining if the particle beam has been successfully injected;

d) upon the particle beam not having been successfully injected, varying at least one injection phase control action, and repeating steps a) to c);

e) upon the particle beam having been successfully injected, performing at least one acceleration phase diagnostic measurement;

f) based upon the at least one acceleration phase diagnostic measurement, determining if the particle beam has been successfully accelerated;

g) upon the particle beam not having been successfully accelerated, varying at least one acceleration phase control action, and repeating steps a) and e) to f);

h) upon the particle beam having been successfully accelerated, performing at least one use phase diagnostic measurement;

i) based upon the at least one use phase diagnostic measurement, determining if the particle beam has been successfully used;

j) upon the particle beam not having been successfully used, varying at least one use phase control action, and repeating steps a) and h) to i); and k) upon the particle beam having been successfully used, further operating the accelerator.

2. The method of claim 1, wherein the particle accelerator is an electron accelerator.

3. The method of claim 1, wherein the particle accelerator is a localized curl accelerator.

4. The method of claim 1, wherein the particle beam is injected by an electron gun.

5. The method of claim 1, wherein whether the particle beam has been successfully injected is determined after one turn.

6. The method of claim 1, wherein whether the particle beam has been successfully injected is determined after a plurality of turns.

7. The method of claim 1, wherein the at least one injection phase diagnostic measurement comprises measuring a number of turns of the beam.

8. The method of claim 7, wherein measuring a number of turns of the beam comprises measuring a pulse in a signal corresponding to a passage of the beam.

9. The method of claim 8, wherein the pulse is measured using a conducting electrode.

10. The method of claim 8, wherein the pulse is measured using a current sensor.

11. The method of claim 7, wherein the at least one injection phase diagnostic measurement comprises measuring beam intensity.

12. The method of claim 7, wherein the at least one injection phase diagnostic measurement comprises measuring a location of the beam.

13. The method of claim 1, wherein the at least one injection phase diagnostic measurement comprises measuring beam intensity.

14. The method of claim 1, wherein the at least one injection phase diagnostic measurement comprises measuring a location of the beam.

15. The method of claim 1, wherein at least one diagnostic measurement comprises a conducting electrode measurement.

16. The method of claim 1, wherein at least one diagnostic measurement comprises a current sensor measurement.

17. The method of claim 16, wherein the current sensor measurement comprises measurement of a power supply current.

18. The method of claim 1, wherein whether the particle beam has been successfully injected or successfully accelerated is determined at least in part by beam intensity.

19. The method of claim 1, wherein whether the particle beam has been successfully injected or successfully accelerated is determined at least in part by beam location.

20. The method of claim 1, wherein use of the particle beam comprises extraction of the beam.

21. The method of claim 1, wherein use of the particle beam comprises the beam impinging upon an internal target.

22. The method of claim 1, further comprising imposing an electric field upon the beam to perturb its orbit by the application of voltage across at least a pair of internal electrodes.

* * * * *